US006591820B2

(12) United States Patent
Kitano et al.

(10) Patent No.: US 6,591,820 B2
(45) Date of Patent: Jul. 15, 2003

(54) AIR-OIL SEPARATING APPARATUS FOR ENGINE

(75) Inventors: Teruaki Kitano, Saitama (JP); Takaaki Katoh, Saitama (JP); Shozo Shiraki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/212,087

(22) Filed: Aug. 6, 2002

(65) Prior Publication Data

US 2003/0024512 A1 Feb. 6, 2003

(30) Foreign Application Priority Data

Aug. 6, 2001 (JP) ..... 2001-238149

(51) Int. Cl.[7] ..... F01M 13/04
(52) U.S. Cl. ..... 123/572; 123/574; 123/573
(58) Field of Search ..... 123/572, 573, 123/574, 41.86

(56) References Cited

U.S. PATENT DOCUMENTS 5,487,371 A * 1/1996 Beckman et al. ..... 123/572
5,507,268 A * 4/1996 Schattl ..... 123/572
5,542,402 A * 8/1996 Lee et al. ..... 123/573
5,564,401 A * 10/1996 Dickson ..... 123/572
5,954,035 A * 9/1999 Hofer et al. ..... 123/573

FOREIGN PATENT DOCUMENTS

JP 10-220215 8/1998

* cited by examiner

*Primary Examiner*—Marguerite McMahon
(74) *Attorney, Agent, or Firm*—Armstrong, Westerman & Hattori, LLP

(57) ABSTRACT

A PCV valve is incorporated in the interior of a centrifugal oil mist separator which is provided integrally on a head cover of an engine. The centrifugal oil mist separator comprises an upstream-side separation chamber including a blow-by gas inlet port and a downstream-side separation chamber to which a blow-by gas outlet port and an oil discharge hole open, and an oil separation plate is disposed such that a communication between the blow-by gas inlet port and the blow-by gas outlet port is cut off. The oil separator plat is provided at a distal end of a protruding portion which integrally extends from a valve seat of the PCV valve, the protruding portion and the oil separation plate functioning to intensify a swirl flow in the upstream-side separation chamber.

13 Claims, 10 Drawing Sheets

AIR-OIL SEPARATING APPARATUS FOR ENGINE

BACKGROUND OF THE INVENTION

1. Field of the Invention

The present invention relates to an air-oil separating apparatus for an engine in which oil mist is separated from blow-by gases by a centrifugal oil mist separator into which blow-by gases are supplied from the engine.

2.Description of the Related Art

Known through JP-A-10-220215 is an air-oil separating apparatus for an engine in which a centrifugal oil mist separator for centrifugally separating oil mist contained in blow-by gases of the engine from the blow-by gases to return oil mist so separated to an oil pan is provided in a blow-by gas recirculation system for returning the blow-by gases from the engine to an intake system to thereby prevent the ejection of the blow-by gases into the atmosphere.

Incidentally, since conventionally, the centrifugal oil mist separator and a PCV valve for controlling the flow rate of blow-by gases are provided separately along a blow-by gas passage, there are caused problems that not only does a space required for installation of the centrifugal oil mist separator and the PCV valve need to be increased but also piping is required for connection of the centrifugal oil mist separator with the PCV valve and the number of man hours for assembling them together needs to be increased.

SUMMARY OF THE INVENTION

The invention was made in view of the situations, and an object thereof is to enhance the oil mist separating performance of an centrifugal oil mist separator by effectively incorporating a PCV valve into the centrifugal oil mist separator.

To solve the above object, according to the first aspect of the invention, there is provided an air-oil separating apparatus for an engine in which oil mist is separated from blow-by gas, comprising: a centrifugal oil mist separator into which the blow-by gas is supplied from the engine; and a PCV valve integrated into the centrifugal oil mist separator in such a manner that the PCV valve protrudes on an axis of a separation chamber of the centrifugal oil mist separator.

According to the second aspect of the invention, in the air-oil separating apparatus according to the first aspect, a protruding portion of the PCV valve which protrudes on the axis of the separation chamber of the centrifugal oil mist separator is formed by extending a valve seat of the PCV valve.

According to the third aspect of the invention, in the air-oil separating apparatus according to the first or second aspect of the invention, an oil separation plate is integrated into the protruding portion of the PCV valve which protrudes on the axis of the separation chamber of the centrifugal oil mist separator, and the oil separation plate is disposed between a blow-by gas inlet port for introducing blow-by gases into the oil separation chamber and a blow-by gas outlet port formed within the protruding portion of the PCV valve.

According to the fourth aspect of the invention, in the air-oil separating apparatus according to the first aspect of the invention, the oil separation plate is disposed between an upstream-side separation chamber to which the blow-by gas inlet port opens and a downstream-side separation chamber to which the blow-by gas outlet port opens, an external thread formed on an outer circumferential surface of a valve housing of the PCV valve is screwed into an internal thread formed in an inner circumferential surface of the upstream-side separation chamber so that the PCV valve is fastened into the centrifugal oil mist separator, the opening of the blow-by gas outlet port is provided to be situated inwardly of an inner end of the internal thread, and the oil separation plate is disposed between the inner end of the internal thread and the opening of the blow-by gas outlet port.

According to the fifth aspect of the invention, in the air-oil separating apparatus according to the first to fourth aspect of the invention, a separation chamber housing of the centrifugal oil mist separator and the valve housing of the PCV valve are integrally formed of a resin.

DETAILED DESCRIPTION OF THE PREFERRED EMBODIMENTS

The mode for carrying out the invention will be described below based on embodiments illustrated in the appended drawings.

Figure 1:
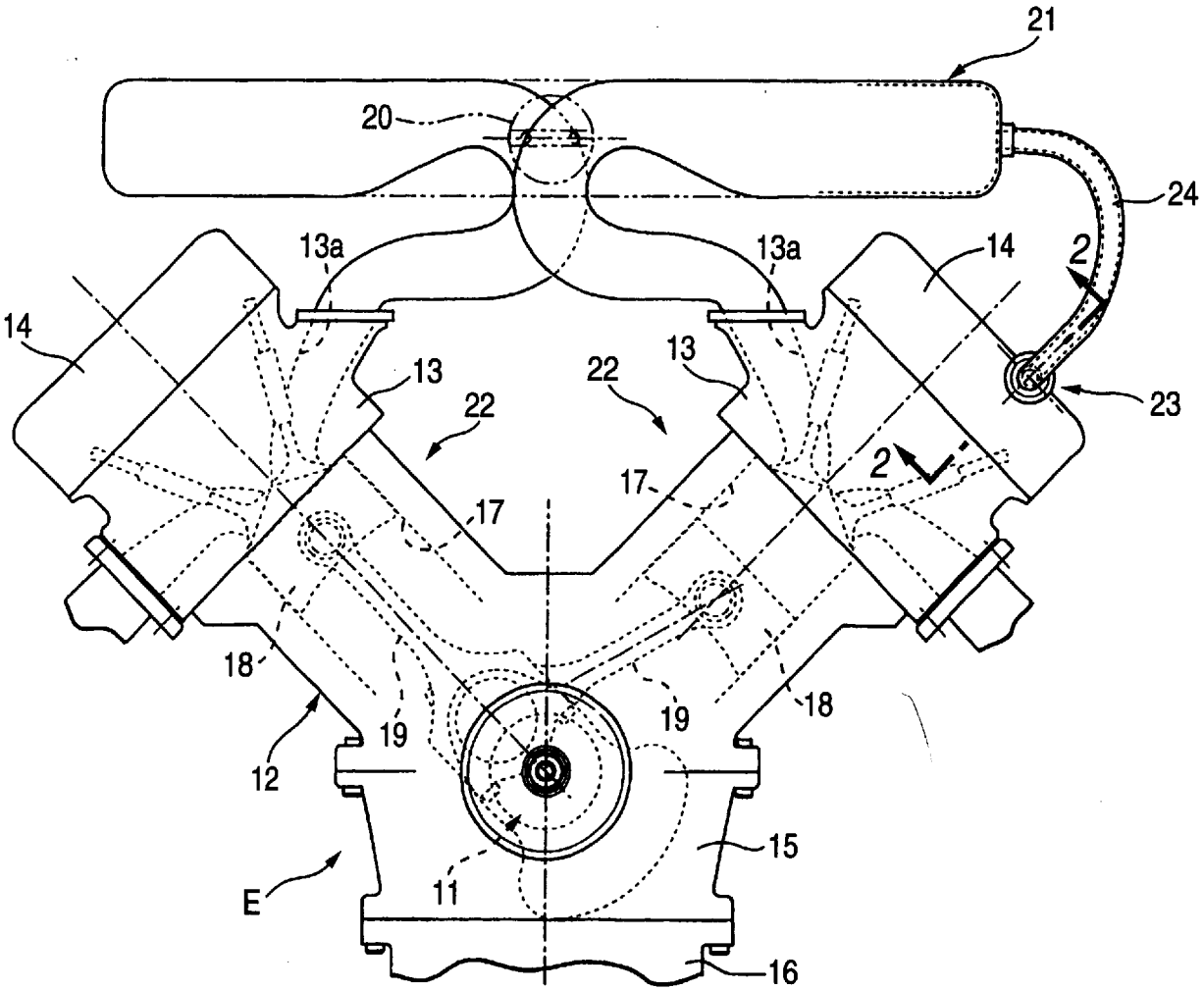
FIG. 1 is a front view of a V-type multi-cylinder engine.
Figure 2:
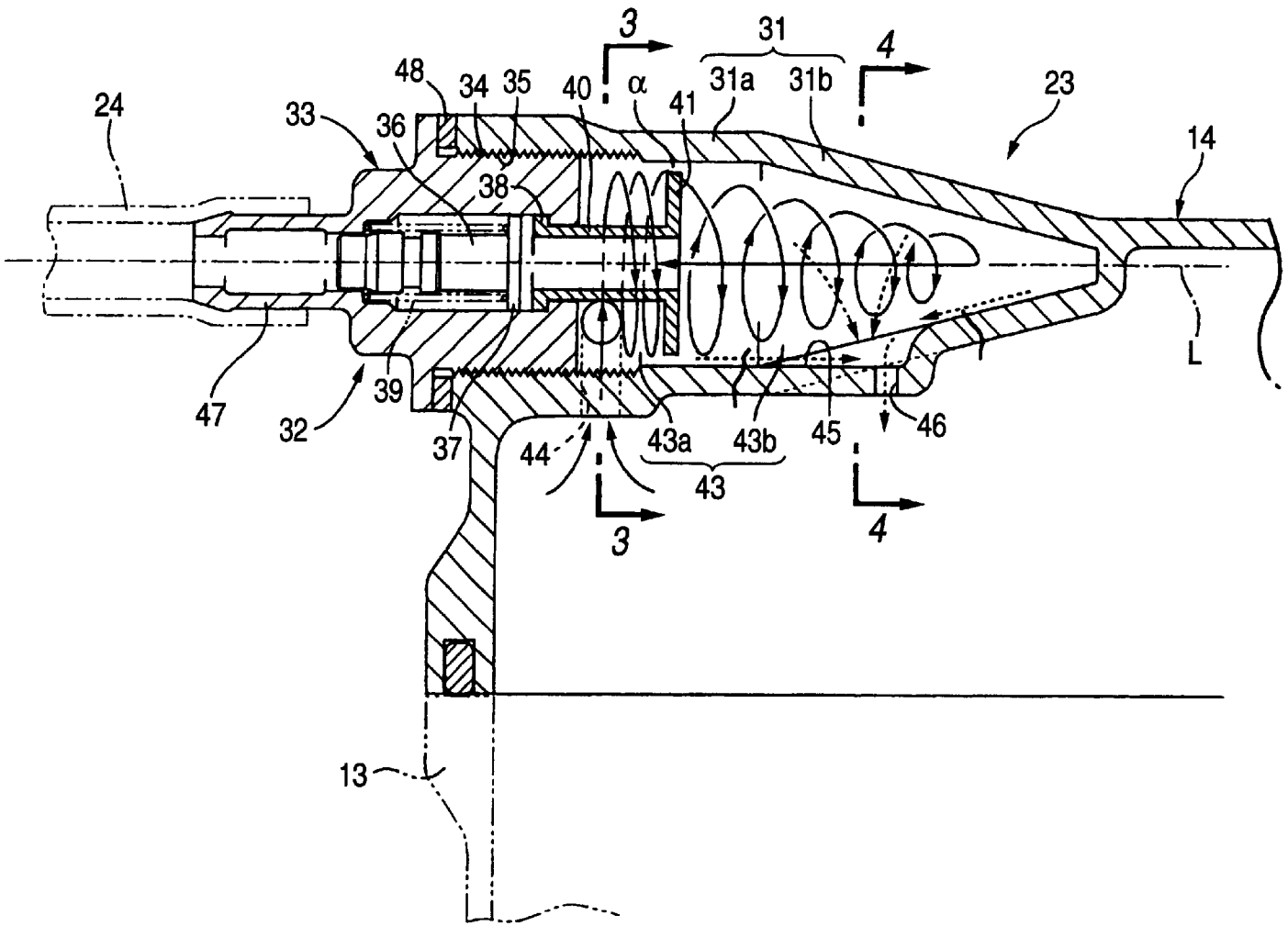
FIG. 2 is an enlarged sectional view taken along the line 2—2 in FIG. 1.
Figure 3:
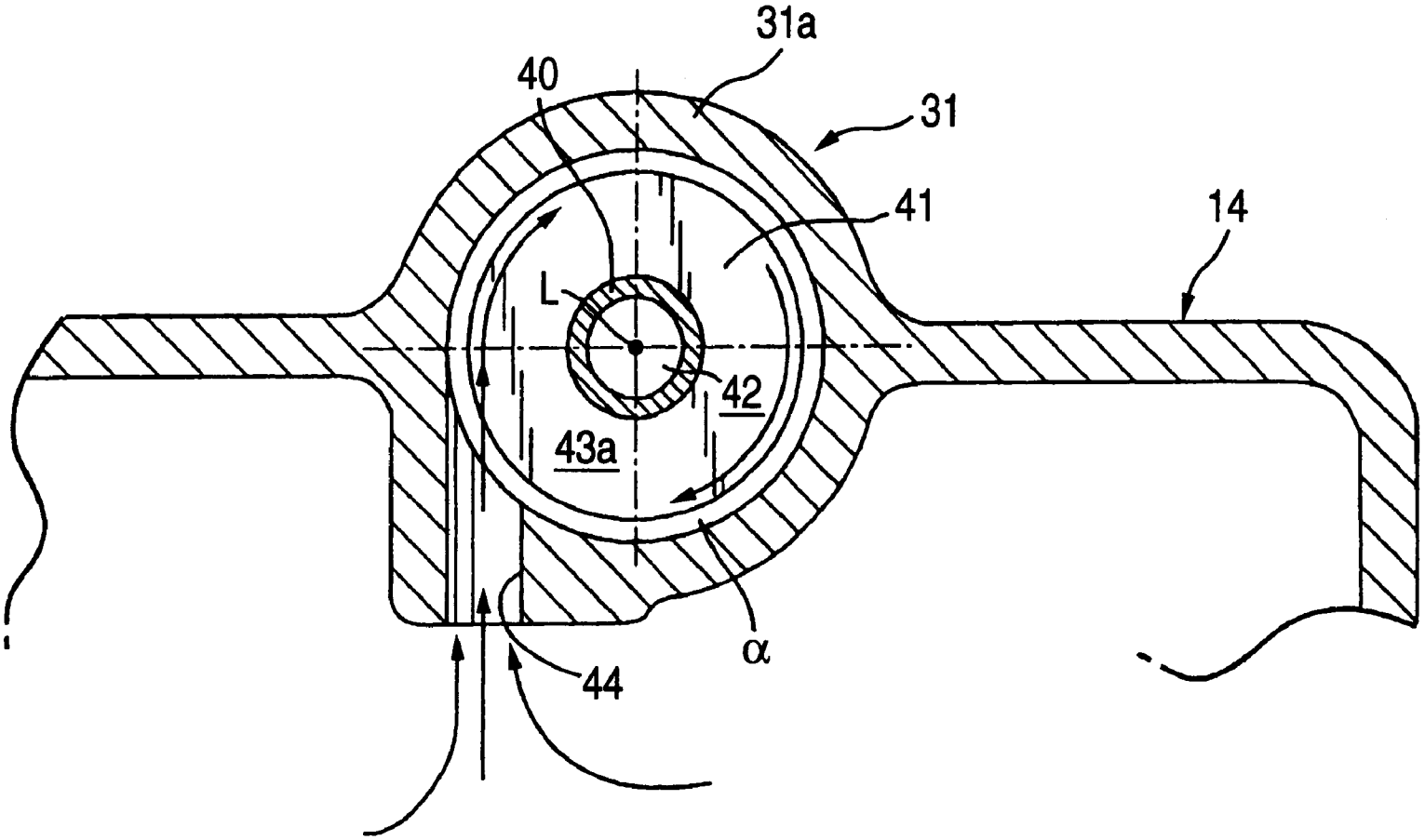
FIG. 3 is a sectional view taken along the line 3—3 in FIG. 2.
Figure 4:
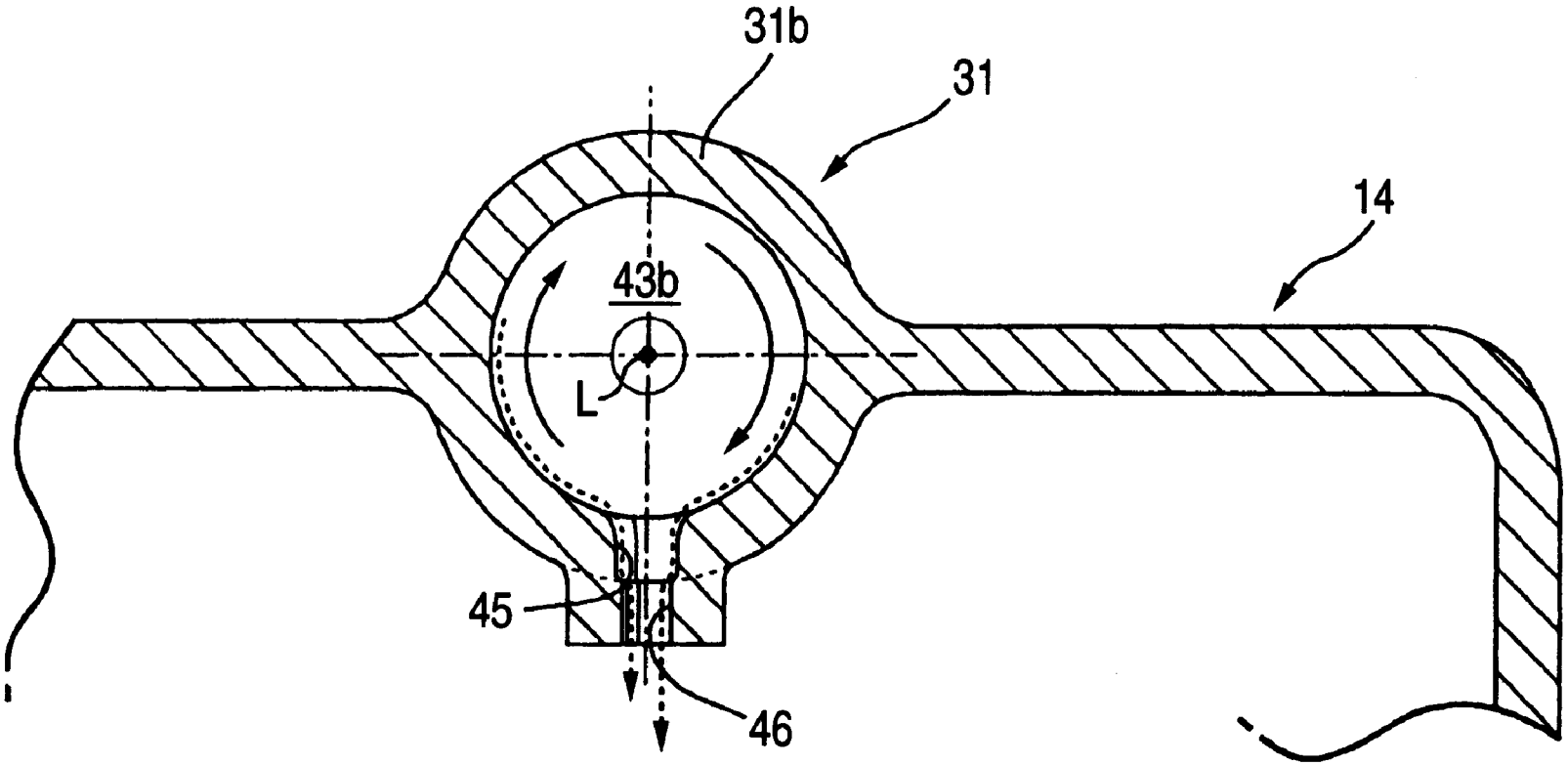
FIG. 4 is a sectional view taken along the line 4—4 in FIG. 2.

FIGS. 1 to 4 show a first embodiment of the invention, in which FIG. 1 is a front view of a V-type multi-cylinder engine, FIG. 2 is an enlarged sectional view taken along the line 2—2 in FIG. 1, FIG. 3 is a sectional view taken along the line 3—3 in FIG. 2, and FIG. 4 is a sectional view taken along the line 4—4 in FIG. 2.

As shown in FIG. 1, the V-type multi-cylinder engine E comprises a V-shaped cylinder block 12, a pair of left and right cylinder heads 13, 13, a pair of left and right head covers 14, 14, a crankcase 15 and an oil pan 16. The V-shaped cylinder block 12 supports a crankshaft 11 at a lower end. The pair of left and right cylinder heads 13, 13 are joined to upper faces of the cylinder block 12. The pair of left and right head covers 14, 14 are joined to upper faces of the cylinder heads 13, 13. The crankcase 15 is joined to a bottom face of the cylinder block 12. The oil pan 16 is joined to a bottom face of the crankcase 15. Left and right pistons 18 . . . , 18 . . . which slidably fit in left and right cylinders 17, 17 formed in the cylinder block 12 connect to a crankshaft 11 via connecting rods 19 . . . , 19 . . . .

Intake manifolds 21 connecting to downstream sides of throttle valves are disposed between left- and right-hand banks 22, 22 of the engine E and connect to intake ports 13*a* . . . in the cylinder heads 13, 13. A centrifugal oil mist separator 23 (an air-oil separating apparatus) which functions according to the principle of a cyclone apparatus is provided on an upper face of the head cover 14 on one of the banks 22 and connects to an intake system (for example, the intake manifold 21) of the engine E via a blow-by gas passage 24.

As shown in FIGS. 2 to 4, a separation chamber housing 31 of the centrifugal oil mist separator 23 is formed integrally on the head cover 14 made of aluminum and comprises a substantially cylindrical upstream-side separation chamber housing 31*a* and a substantially conical downstream-side separation chamber housing 31*b* which housings are made integral with each other. The separation chamber housing 31 is disposed with its axis L being maintained horizontally, and a PCV valve (positive crankcase ventilation valve) 32 is integrally provided at an end portion of the upstream-side separation chamber housing 31*a* which is opposite to an end thereof which faces the downstream-side separation chamber housing 31*b*. An external thread 34 formed on an outer circumferential surface of the valve housing 33, which is made of aluminum, of the PCV valve 32 is screwed into an internal thread 35 formed in an inner circumferential surface of the upstream-side separation chamber housing 31*a*, whereby the valve housing 33 is fixed in the upstream-side separation chamber housing 31*a*. In addition, an annular seal member 48 is interposed between the separation chamber housing 31 and the valve housing 33.

A valve shaft 36 and a valve element 37 which are formed integrally are movably supported along the axis L in the interior of the hollow valve housing 33, and the valve shaft 36 and the valve element 37 are biased by a valve spring 39 to the right with a view to allow the valve element 37 to be seated on an annular valve seat 38 fixed to a right end of the valve housing 33. An annular oil separation plate 41 is integrally formed at a right end of a pipe-like protruding portion 40 which integrally protrudes to the right from the valve seat 38, and there is formed a gap $\alpha$ between an outer circumferential surface of the oil separation plate 41 and the inner circumferential surface of the separation chamber housing 31. A blow-by gas outlet port 42 is formed in the interior of the protruding portion 40. A separation chamber 43 defined in the interior of the separation chamber housing 31 is partitioned into an upstream-side separation chamber 43*a* which is situated on the left-hand side of the oil separation plate 41 and a downstream-side separation chamber 43*b* situated on the right-hand side of the oil separation plate 41.

As is clear when referring also to FIG. 3, a blow-by gas inlet port 44 for establishing a communication between an internal space in the head cover 14 and the upstream-side separation chamber 43*a* is formed in a lower face of the upstream-side separation chamber housing 31*a*. The blow-by gas inlet port 44 opens in a tangential direction relative to an inner circumferential wall of the upstream-side separation chamber 43*a* so that a swirl flow is generated in blow-by gases supplied from the internal space of the head cover 14 into the upstream-side separation chamber 43*a*.

As is clear when referring also to FIG. 4, an oil guide groove 45 which communicates horizontally with a bottom portion of the cylindrical upstream-side separation chamber housing 31*a* is formed in a bottom portion of the conical downstream-side separation chamber housing 31*b* to collect liquid or oil adhering to the inner surface of the upstream-side separation chamber housing 31*a* and oil adhering to the inner circumferential wall of the downstream-side separation chamber housing 31*b*. An oil discharge hole 46 communicating with the internal space of the head cover 14 is formed in the oil guide groove 45.

Next, the function of the first embodiment of the invention which is constructed as has just been described above will be described.

When an intake negative pressure is exerted on the PCV valve 32 which connects to the intake manifold 21 via the blow-by gas passage 24, the valve element 37 moves away from the valve seat 38 against the valve spring 39, and the intake negative pressure is applied to the separation chamber 43 of the centrifugal oil mist separator 23. As a result, blow-by gases staying in the internal space of the head cover 14 which contain oil mist then flow into the upstream-side separation chamber 43*a* via the blow-by gas inlet port 44 formed in the upstream-side separation chamber housing 31*a*. Since the blow-by gas inlet port 44 opens in the tangential direction of the cylindrical inner wall surface of the upstream-side separation chamber 43*a*, a swirl flow is generated in such a manner as to surround the protruding portion 40 of the PCV valve 32 within the interior of the upstream-side separation chamber 43*a*, whereby mist-like oil contained in the blow-by gases is diffused radially outwardly by virtue of a centrifugal force to adhere to the inner wall surface of the upstream-side separation chamber 43*a*.

Then, since the oil separation plate 41 is interposed between the blow-by gas outlet port 42 formed in the interior of the protruding portion 40 of the PCV valve 32 and the blow-by gas inlet port 44, the short-circuit of the blow-by gas inlet port 44 and the blow-by outlet port 42 is prevented, and moreover, since the protruding portion 40 of the PCV valve 32 which protrudes on the axis L of the upstream-side separation chamber 43*a* constitutes a guide member, a strong swirl flow can be generated in the interior of the upstream-side separation chamber 43*a* to thereby improve the separation effect of oil mist. Blow-by gases which flow from the upstream-side separation chamber 43*a* into the downstream-side separation chamber 43*b* after passing through the gap $\alpha$ around the oil separation plate 41 swirls further, whereby oil mist so separated is then caused to adhere to the inner wall surface of the downstream-side separation chamber 43*b*.

The oil that has come to adhere to the inner wall surface of the separation chamber 43 and the oil that has come to adhere to the surfaces of the protruding portion 40 and the oil separator plate 41 are then collected into the oil guide groove 45 formed in the bottom portion of the separation chamber 43 by gravity and is then returned to the oil pan 16 from the oil discharge hole 46 opened in the bottom portion of the oil groove 45 via the internal space in the head cover 14. On the other hand, the blow-by gases from which the oil mist has been removed are then drawn into the intake manifold 21 from the downstream-side separation chamber 43*b* via the blow-by gas passage 24 connecting to a joint 47 to the PCV valve 32 after passing the blow-by gas outlet port 42 formed in the protruding portion 40 of the PCV valve 32 and between the valve element 37 and the valve seat 38 of the PCV valve 32, whereby unburned hydrocarbon contained in the blow-by gases can be burned in the engine E, the crankcase 15 being thereby forced to be ventilated to prevent, for example, the deterioration of oil.

Incidentally, while oil is easy to stay on ridges of the internal thread 35 when it is exposed from the inner surface of the upstream-side separation chamber housing 31*a,* oil so staying on the ridges can securely be blown off by generating a strong swirl flow in the upstream-side separation chamber 43*a* which the internal thread 35 faces. Thus, the necessity can be obviated of matching the length of the external thread 34 on the valve housing 33 and the length of the internal thread 35 in the upstream-side separation chamber housing 31*a* with accuracy in order to prevent the exposure of the internal thread 35, this contributing the reduction in machining costs. In addition, since the protruding portion 40 is formed by extending in the axial direction L from the valve seat 38 of the PCV valve 32, no special members for constituting the protruding portion 40 are required, whereby the number of components involved can be reduced.

Furthermore, since the oil separator plate 41 is disposed between the inner end of the internal thread 35 (the right end in FIG. 2) and the opening of the blow-by gas outlet port 42, even if oil staying on the ridges of the internal thread 35 is blown off by the swirl flow, the oil so blown off can be prevented from being drawn into the blow-by gas outlet port 42 by the oil separator plate 41. Moreover, the protruding portion 40 of the PCV valve 32 is supported with the inner end of the valve housing 33 being allowed to extend inwardly of the valve seat 38, the supporting rigidity of the protruding portion 40 is improved, so that stable swirl flows can be obtained, this contributing to the improvement in the vapor-liquid separation effect.

As has been described heretofore, since the PCV valve 32 is integrally incorporated into the centrifugal oil mist separator 23, the installation space can be reduced when compared to a case where the centrifugal oil mist separator 23 and the PCV valve 32 are provided separately to thereby make the engine smaller in size, and moreover, piping for connecting the centrifugal oil mist separator 23 to the PCV valve 32 can be eliminated to thereby reduce the numbers of components involved and man hours for assembling them together. In addition, since the protruding portion 40 of the PCV valve 32 is allowed to protrude into the interior of the separation chamber 43, there is provided no possibility that the centrifugal oil mist separator 23 is enlarged, and moreover, swirl flows can effectively be generated by the annular space formed between the separation chamber 43 and the protruding portion 40, thereby making it possible to enhance the oil-mist separation effect. Furthermore, since the PCV valve 32 is provided on a downstream side of the flow of blow-by gas in the separation chamber 43, the amount of oil adhering to an entrance portion of the PCV valve 32 can be reduced, and hence the amount of oil drawn into the intake system can be reduced largely.

In addition, since the centrifugal oil mist separator 23 is transversely placed on the upper face of the head cover 14, the joint 47 for jointing the blow-by gas passage 24 to the PCV valve 32 is allowed to extend horizontally, this contributing to making compact the vertical dimension of the engine E. In particular, in a case where the engine E is mounted at the front part of the vehicle (a front-engine layout), this is effective in keeping the height of the engine-hood line lower. Furthermore, the transverse placement of the centrifugal oil mist separator 23 on a side face of the head cover 14 is more effective in making compact the vertical dimension of the engine E. In addition, since the centrifugal oil mist separator 23 is provided at a connecting portion between the upper and side faces or at the corner portion of the head cover 14, not only can the rigidity of the centrifugal oil mist separator 23 be increased but also a vibration damping effect can be expected due to the increase in rigidity of the head cover 14. Moreover, since the centrifugal oil mist separator 23 is integrated into the head cover 14, the air-oil separating apparatus can be made more compact in size.

Figure 5:
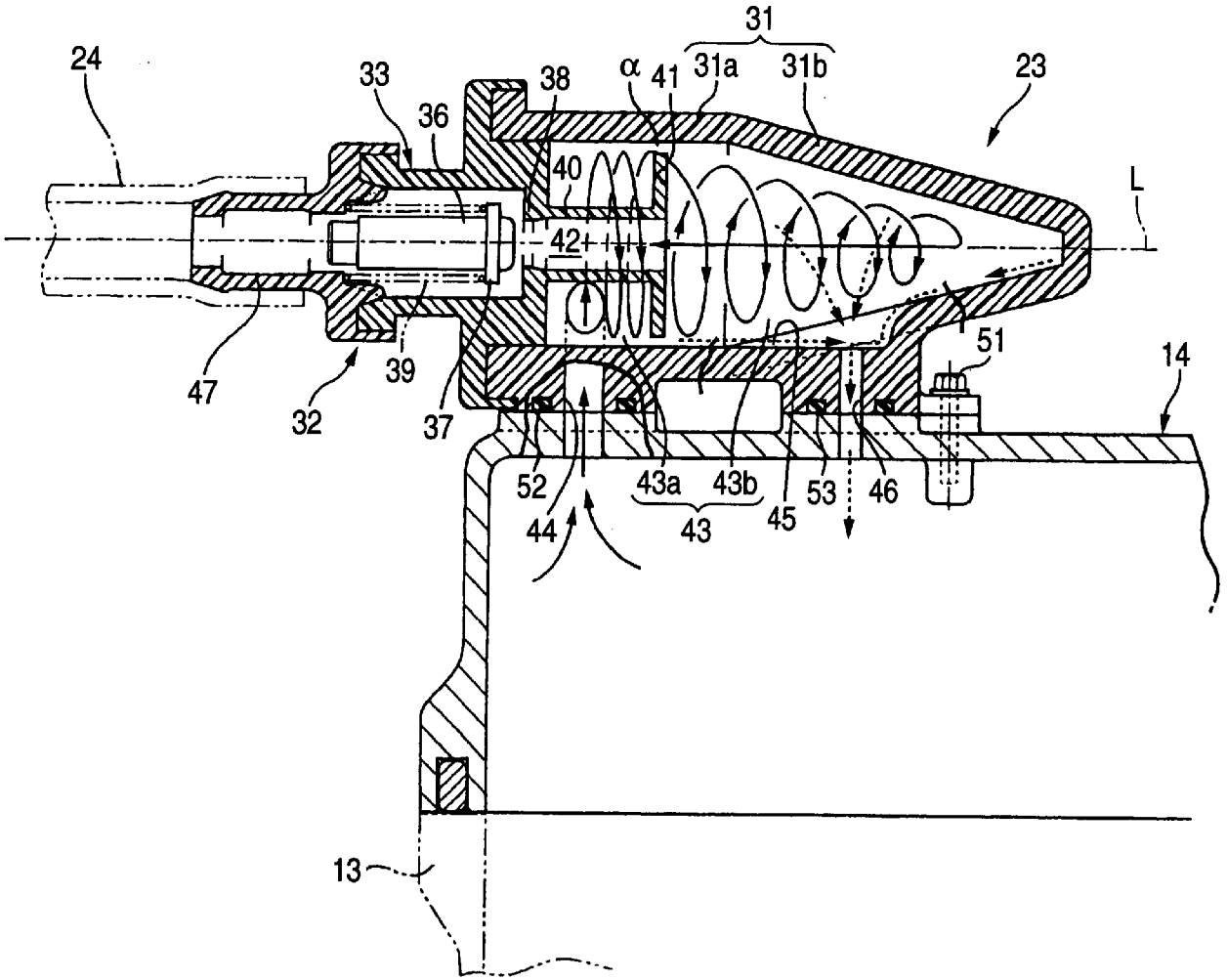
FIG. 5 is a longitudinal sectional view of a centrifugal oil mist separator according to a second embodiment of the invention.

Next, a second embodiment of the invention will be described with reference to FIG. 5. Note that in the embodiments described below including the second embodiment, like reference numerals will be imparted to like members to those described with reference to the first embodiment.

While the centrifugal oil mist separator 23 according to the first embodiment is made of aluminum as in the case with the head cover 14, a centrifugal oil mist separator 23 is made from a synthetic resin. A separation chamber housing 31 is fastened to a head cover 14 with bolts 51 . . . , and since O-rings 52, 53 functioning as seal members are attached, respectively, to peripheries of a blow-by gas inlet port 44 and an oil discharge hole 46 at the joint surface to the head cover 14, an oil leakage can be prevented. Furthermore, in the event that the O-ring 52 on the blow-by gas inlet port 44 side and the O-ring 53 on the oil discharge hole 46 side are formed integrally into each other, not only can the number of components involved be reduced but also the assembling efficiency of centrifugal oil mist separator 23 can be improved. In addition, the separation chamber housing 31 and the valve housing 33 are joined together through welding, but not through screws, and the separate joints 47 are attached to the valve housing 33 through welding. Then, the protruding portion 40 and the oil separation plate 41 is molded integrally on the valve housing 33 of the PCV valves 32.

Figure 6:
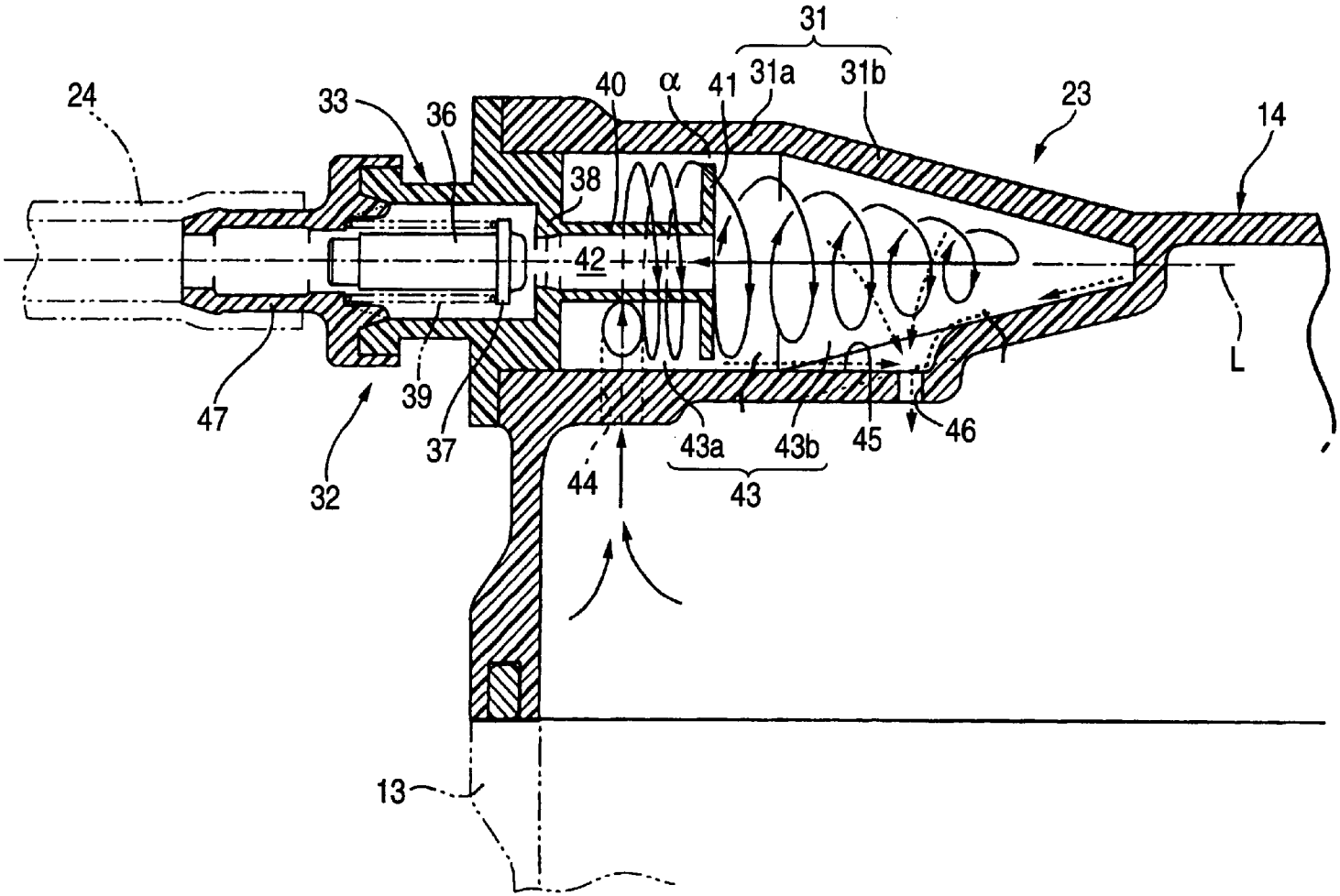
FIG. 6 is a longitudinal sectional view of a centrifugal oil mist separator according to a third embodiment of the invention.

Next, a third embodiment of the invention will be described with reference to FIG. 6.

The third embodiment is a further modification to the second embodiment, in which a separation chamber housing 31 of a centrifugal oil mist separator 23 is integrally formed on a head cover 14 made from a synthetic resin.

While the function and effects of the third embodiment are identical to those of the first and second embodiments, the second embodiment in which the centrifugal oil mist separator is formed from the synthetic resin can provide the advantage that the weight of the apparatus can be reduced, and the third embodiment in which both the centrifugal oil mist separator and the head cover 14 are made from the synthetic resin provides another advantage that the weight of the apparatus can be reduced further.

Figure 7:
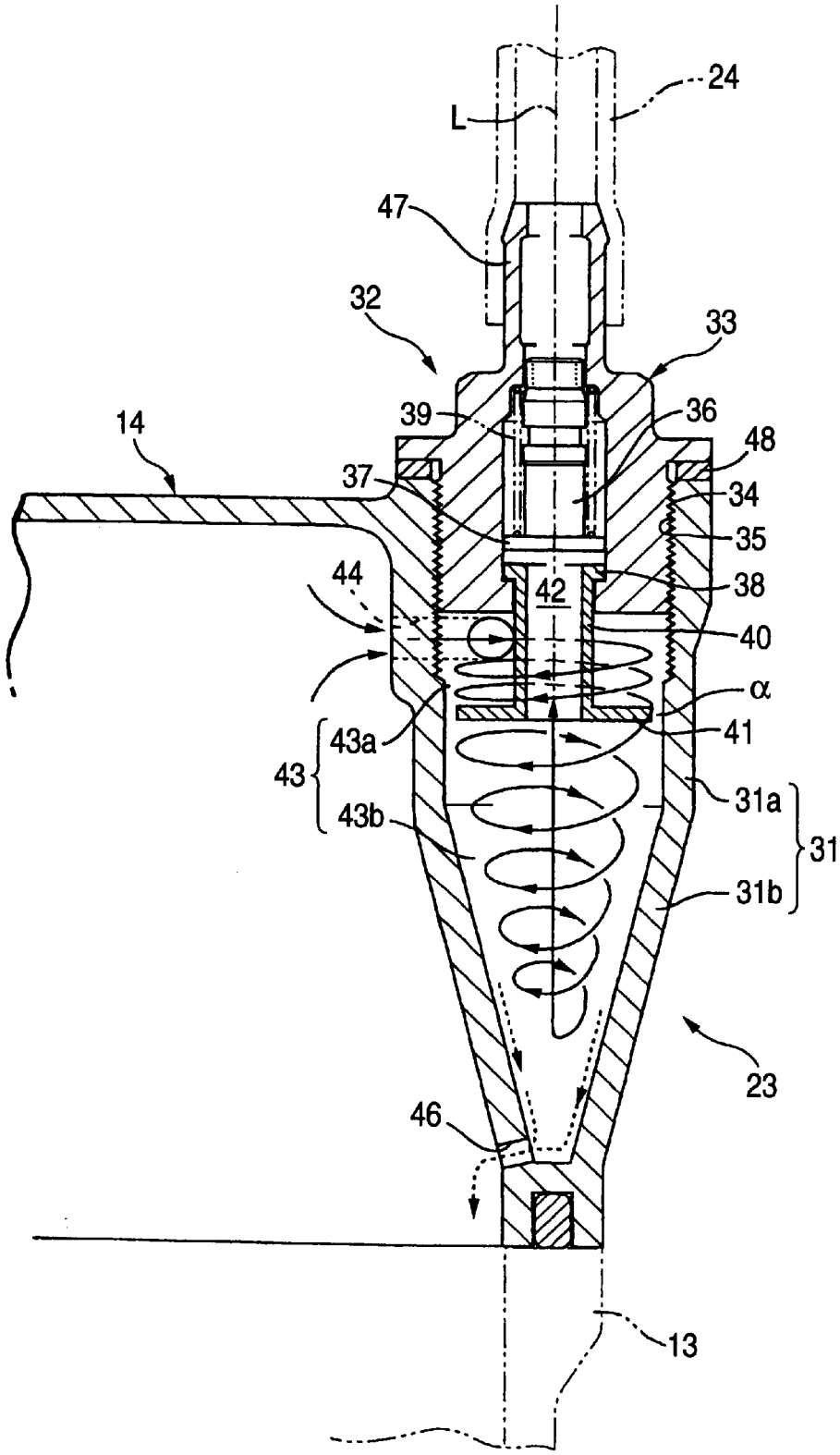
FIG. 7 is a longitudinal sectional view of a centrifugal oil mist separator according to a fourth embodiment of the invention.

Next, a fourth embodiment will be described with reference to FIG. 7.

The fourth embodiment is such as to correspond to the first embodiment, in which a centrifugal oil mist separator 23, which is placed transversely on the upper face of the head cover 14 in the first embodiment, is now placed vertically on a side of a head cover 14. Other differences are that while the oil discharge hole 46 in the centrifugal oil mist separator 23 according to the first embodiment is formed in the bottom portion of the oil guide groove 45 formed in the lower face of the separation chamber housing 31, no oil guide groove 45 is formed in the centrifugal oil mist separator 23 according to the fourth embodiment and that an oil discharge hole 46 is provided in a lower end of a downstream-side separation chamber 43.

The fourth embodiment can provide the same function and effects as those of the first embodiment, and in addition thereto, since the separation chamber 43 is disposed vertically, the fourth embodiment can provide another advantage that oil adhering to an inner wall surface of the separation chamber 43 is effectively guided into the oil discharge hole 46 by gravity.

Next, based on FIGS. 8 and 9 fifth and sixth embodiment will be described.

Figure 8:
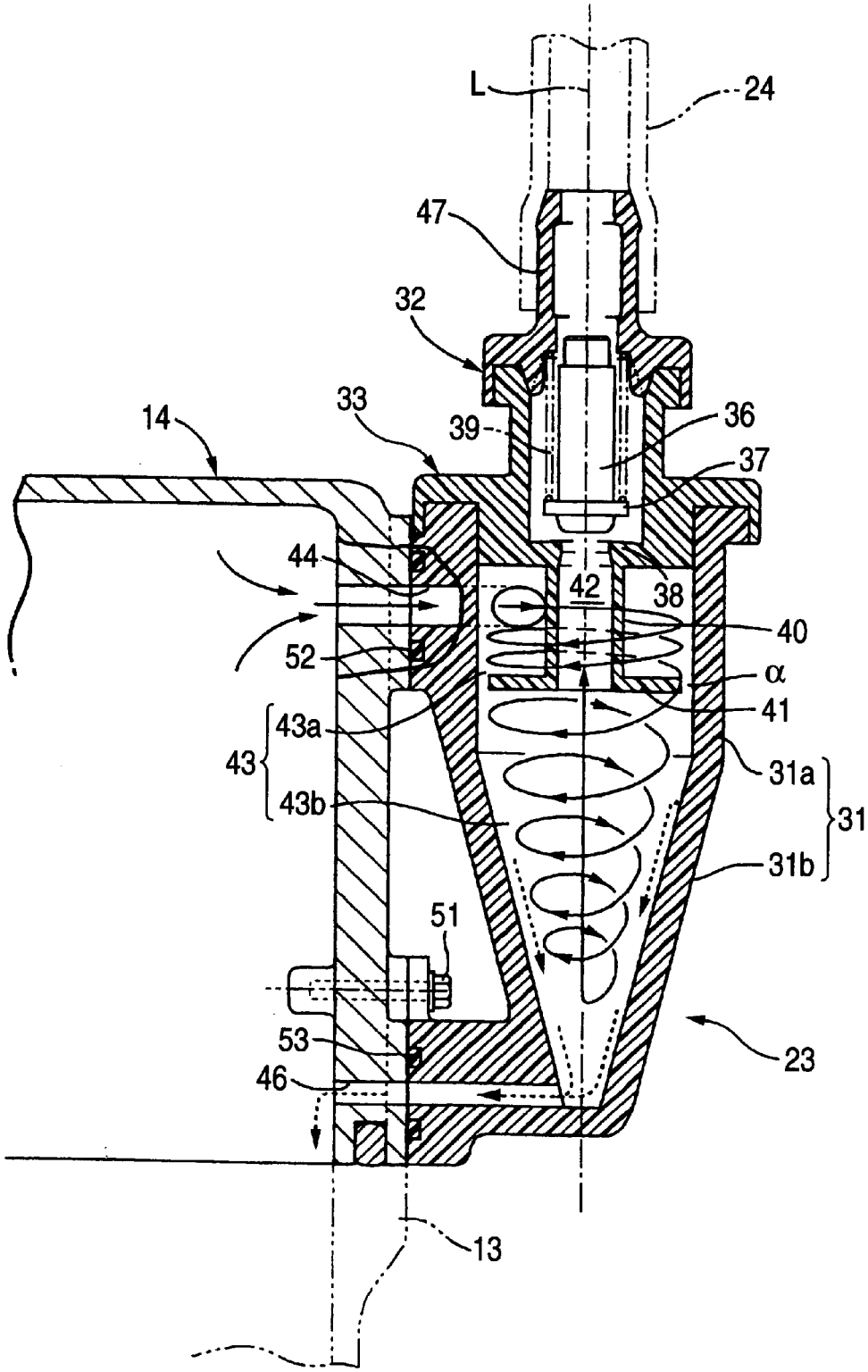
FIG. 8 is a longitudinal sectional view of a centrifugal oil mist separator according to a fifth embodiment of the invention.
Figure 9:
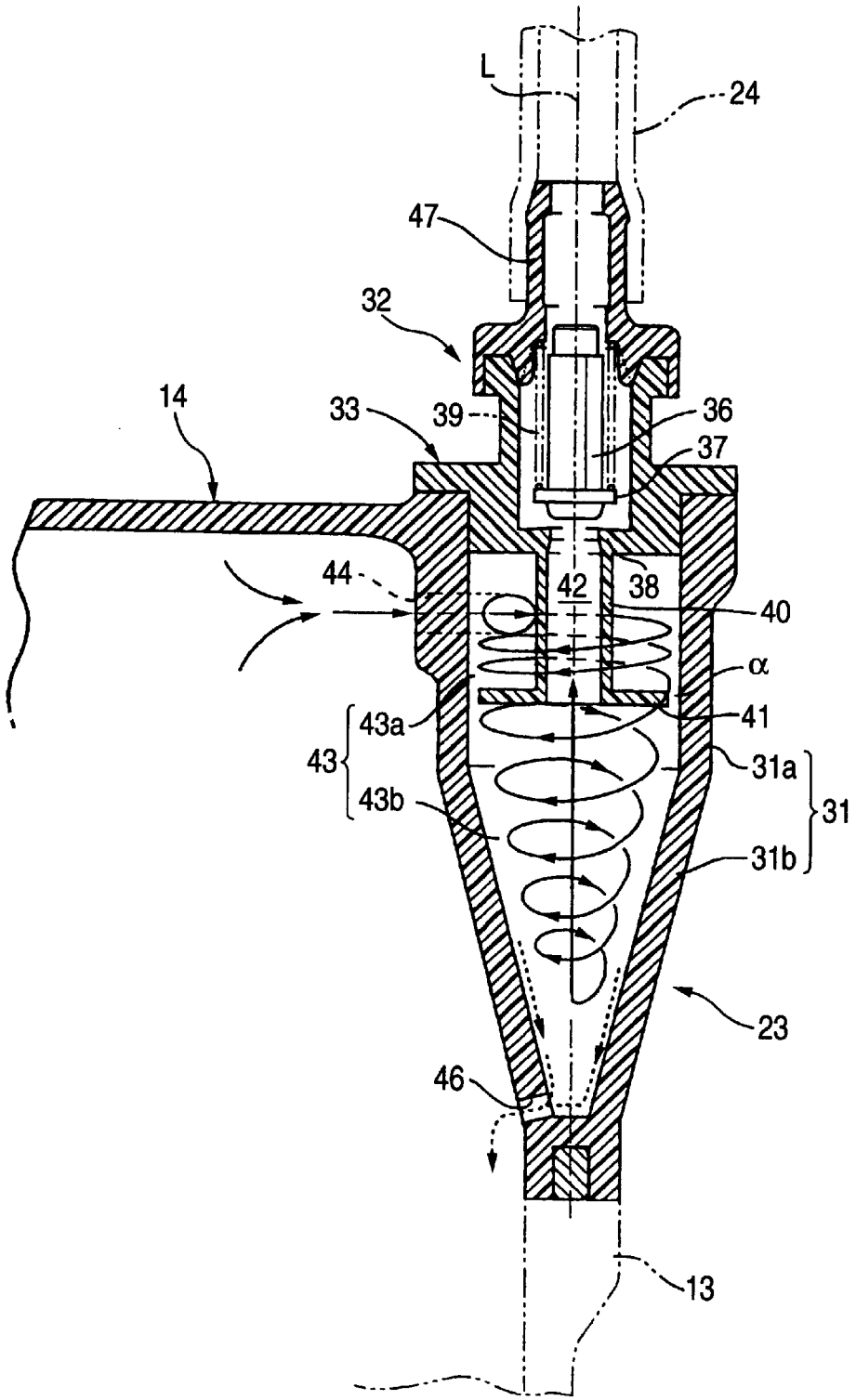
FIG. 9 is a longitudinal sectional view of a centrifugal oil mist separator according to a sixth embodiment of the invention.

The fifth embodiment shown in FIG. 8 is such as to correspond to the second embodiment, in which a centrifugal oil mist separator 23 which is made from a synthetic resin is attached to a side of a head cover 14 made of aluminum. In addition, the sixth embodiment shown in FIG. 9 is such as to correspond to the third embodiment, in which a separation chamber housing 31 of a centrifugal oil mist separator 23 which is made from a synthetic resin is integrally formed on a side of a head cover 14 made from a synthetic resin. In addition to those provided by the second and third embodiments, the fifth and sixth embodiment can provide a further advantage that the weight of the apparatus can further be reduced.

Figure 10:
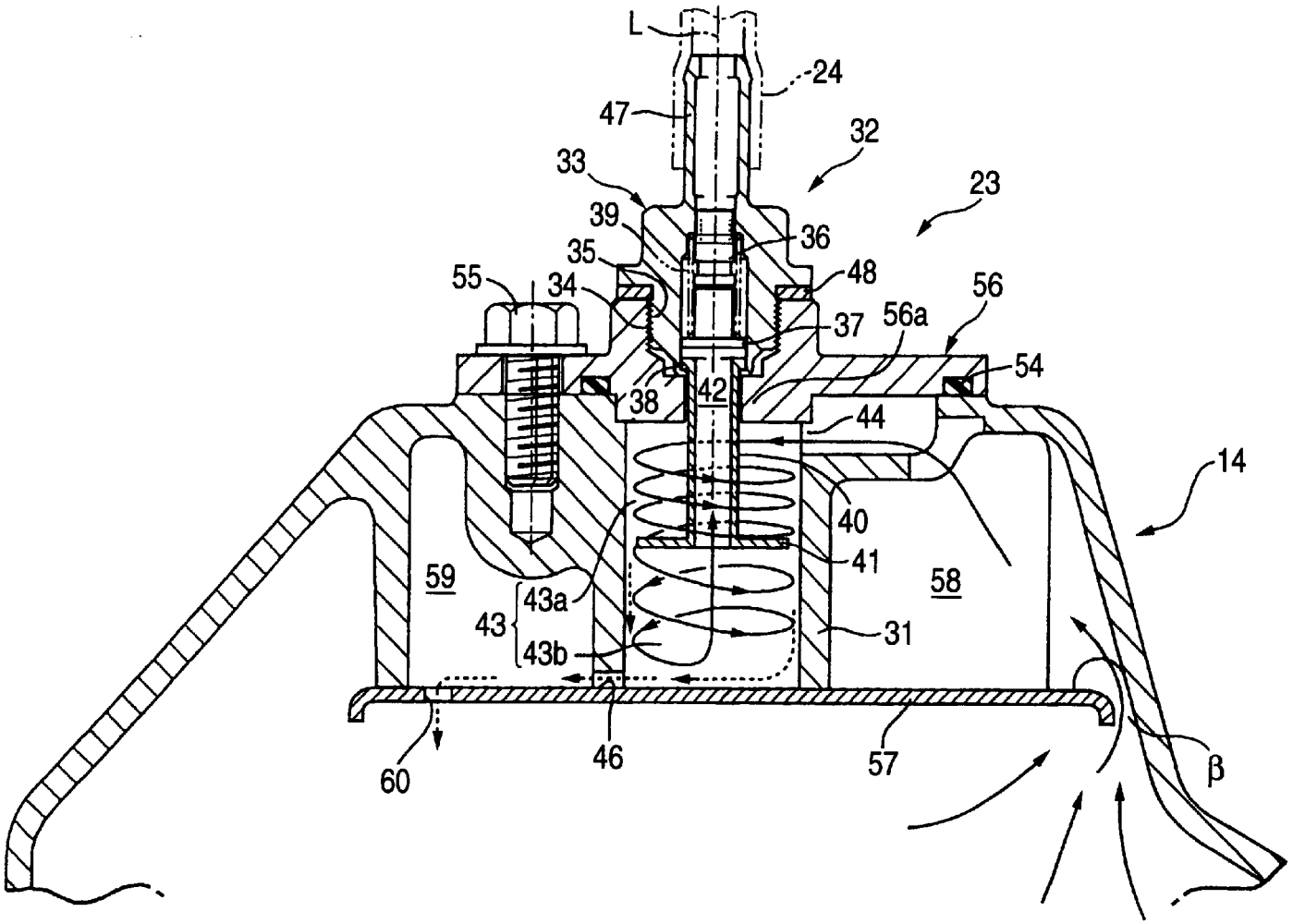
FIG. 10 is a longitudinal sectional view of a centrifugal oil mist separator according to a seventh embodiment of the invention.

Next, based on FIG. 10 a seventh embodiment will be described.

In the seventh embodiment, a centrifugal oil mist separator 23 which is made from a synthetic resin is provided at an upper portion of a head cover 14 which is made of aluminum, and a cylindrical separation chamber housing 31 is formed integrally on an inner surface of the head cover 14 with its axis L being oriented vertically. An opening in an upper face of the separation chamber housing 31 is closed with a cover 56 fixed with bolts 55 . . . via a seal member 54, and an opening in a lower face of the separation chamber housing 31 is closed by a bottom plate 57. A PCV valve 32 having the same construction as that of the PCV valve 32 which is described with respect to the first embodiment (refer to FIG. 2) is provided in the oil mist separator cover 56, and a valve housing 33 is fastened to the oil mist separator cover 56.

An internal space of the head cover 14 communicates with a labyrinth chamber 58 via a gap β between an edge portion of the bottom plate 57 and the inner surface of the head cover 14, and further communicates with an upstream-side separation chamber 43*a* via a blow-by gas inlet port 44 from there in a tangential direction. In addition, a lower end of a downstream-side separation chamber 43*b* communicates with the internal space of the head cover 14 via an oil discharge hole 46, an oil discharge chamber 59 and an oil discharge hole 60.

In addition to the function and effect provided by the fourth embodiment, the seventh embodiment can provide a further advantage that the engine E can be made smaller in size by receiving the separation chamber housing 31 in the interior of the head cover 14.

In particular, since a partition wall 56*a* for constituting a partition between the upstream-side separation chamber 43*a* and an internal thread 35 is formed in the oil mist separator cover 56 in such a manner as to face a protruding portion 40 of the PCV valve 32, the adherence of oil to the internal thread 35 can be restrained. Moreover, since the partition wall 56*a* extends as far as a position where the blow-by gas inlet port 44 is situated, a swirl flow in the upstream-side separation chamber 43 can be stabilized further to thereby improve the effect of separating mist from oil. Furthermore, since the partition wall 56*a* is formed integrally on the oil mist separator cover 56, the number of components can be prevented from increasing, and the fastening rigidity of the PCV valve 32 to the oil mist separator cover 56 can also be improved.

Thus, while the embodiments of the invention have been described heretofore, the invention may be modified variously with respect to its design without departing from the spirit and scope thereof.

With a view to attaining the object, according to a first aspect of the invention, there is proposed an air-oil separating apparatus for an engine in which oil mist is separated from blow-by gases by a centrifugal oil mist separator into which blow-by gases are supplied from the engine, characterized in that a PCV valve is integrated into the centrifugal oil mist separator in such a manner that the PCV valve protrudes on an axis of a separation chamber of the centrifugal oil mist separator.

According to the above construction, since the PCV valve is integrated into the centrifugal oil mist separator, not only can a space required for installation thereof be reduced when compared with a case where they are provided separately to thereby make the entirety of the engine smaller in size but also the number of components and man hours for assembling them together can be reduced by obviating the necessity of piping for connecting the centrifugal oil mist separator with the PCV valve. Furthermore, since the PCV valve is allowed to protrude on the axis of the separation chamber, the centrifugal oil mist separator can advantageously be made smaller in size, and moreover, since there is formed an annular space between an inner circumferential surface of the separation chamber and an outer circumferential surface of the protruding portion of the PCV valve, a swirl flow generated in the separation chamber can be intensified to enhance the effect of separating mist from oil.

According to a second aspect of the invention, there is proposed an air-oil separating apparatus for an engine as set forth in the first aspect of the invention, wherein a protruding portion of the PCV valve which protrudes on the axis of the separation chamber of the centrifugal oil mist separator is formed by extending a valve seat of the PCV valve.

According to the above construction, since the protruding portion is constructed in such a manner as to protrude on the axis of the separation chamber by extending the valve seat of the PCV valve, a swirl flow generated in the separation chamber can be intensified to enhance the separation effect of mist from oil without the necessity of any special parts for the construction of the protruding portion.

According to a third aspect of the invention, there is proposed an air-oil separating apparatus for an engine as set forth in the first or second aspect of the invention, wherein an oil separation plate is integrated into the protruding portion of the PCV valve which protrudes on the axis of the separation chamber of the centrifugal oil mist separator in such a manner that the oil separation plate is disposed between a blow-by gas inlet port for introducing blow-by gases into the oil separation chamber and a blow-by gas outlet port formed within the protruding portion of the PCV valve.

According to the above construction, since the oil separation plate which is integrated into the protruding portion of the PCV valve which protrudes on the axis of the separation chamber of the centrifugal oil mist separator is disposed between the blow-by gas inlet port for introducing blow-by gases into the separation chamber and the blow-by gas outlet port which is formed within the protruding portion of the PCV valve, the swirl flow between the blow-by gas inlet port and the oil separation plate can be intensified not only to improve the effect of separating mist from oil but also to contribute to the reduction in the number of components by obviating the necessity of any special parts for supporting the oil separation plate.

According to a fourth aspect of the invention, there is proposed an air-oil separating apparatus for an engine as set forth in the first aspect of the invention, wherein the oil separation plate is disposed between an upstream-side separation chamber to which the blow-by gas inlet port opens and a downstream-side separation chamber to which the blow-by gas outlet port opens, wherein an external thread formed on an outer circumferential surface of a valve housing of the PCV valve is screwed into an internal thread formed in an inner circumferential surface of the upstream-side separation chamber so that the PCV valve is fastened into the centrifugal oil mist separator, wherein the opening of the blow-by gas outlet port is provided to be situated inwardly of an inner end of the internal thread, and wherein the oil separation plate is disposed between the inner end of the internal thread and the opening of the blow-by gas outlet port.

According to the above construction, since the oil separation plate is disposed between the upstream-side separation chamber to which the blow-by gas inlet port opens and the downstream-side separation chamber to which the blow-by gas outlet port opens, a swirl flow in the upstream-side separation chamber to which the blow-by gas inlet port opens can be intensified to thereby improve the oil-mist separation effect. In addition, since oil which adheres to the internal thread formed in the inner circumferential surface of the upstream-side separation chamber can securely blown off the thread, the necessity of matching with accuracy the lengths of the external thread formed on the outer circumferential surface of the valve housing of the PCV valve and the internal thread can be obviated, which can contribute to the reduction in the machining costs. Moreover, since the opening of the blow-by gas outlet port is provided to be situated inwardly of the inner end of the internal thread and the oil separation plate is disposed between the inner end of the internal thread and the oil separation plate, even when oil adhering to the internal thread is blown off the thread by the swirl flow, the penetration of the oil so blown off can be prevented by the oil separation plate so provided.

According to a fifth aspect of the invention, there is proposed an air-oil separating apparatus for an engine as set forth in any of the aspects 1 to 4 of the invention, wherein a separation chamber housing of the centrifugal oil mist separator and the valve housing of the PCV valve are integrally molded from a resin.

According to the above construction, since the separation chamber housing of the centrifugal oil mist separator and the valve housing of the PCV valve are molded integrally from a resin, this can contribute to the reduction in the numbers of components and man hours, as well as in weight of the air-oil separating apparatus for an engine.

What is claimed is:

1. An air-oil separating apparatus for an engine in which oil mist is separated from blow-by gas, comprising:

a centrifugal oil mist separator into which the blow-by gas is supplied from said engine; and a PCV valve integrated into said centrifugal oil mist separator in such a manner that said PCV valve protrudes on an axis of a separation chamber of said centrifugal oil mist separator.

2. The air-oil separating apparatus according to claim 1, wherein said PCV valve includes a protruding portion which protrudes on the axis of said separation chamber of said centrifugal oil mist separator, said protruding portion being formed by extending a valve seat of said PCV valve.

3. The air-oil separating apparatus according to claim 2, wherein an oil separation plate is integrated into said protruding portion of said PCV valve, said oil separation plate being disposed between a blow-by gas inlet port for introducing the blow-by gas into said oil separation chamber and a blow-by gas outlet port formed within said protruding portion of said PCV valve.

4. The air-oil separating apparatus according to claim 1, wherein an oil separation plate is integrated into a protruding portion of said PCV valve which protrudes on the axis of said separation chamber of said centrifugal oil mist separator, and wherein said oil separation plate is disposed between a blow-by gas inlet port for introducing the blow-by gas into said oil separation chamber and a blow-by gas outlet port formed within said protruding portion of said PCV valve.

5. The air-oil separating apparatus according to claim 1, wherein an oil separation plate is disposed between an upstream-side separation chamber to which an blow-by gas inlet port opens and a downstream-side separation chamber to which an blow-by gas outlet port opens, wherein an external thread formed on an outer circumferential surface of a valve housing of said PCV valve is screwed into an internal thread formed in an inner circumferential surface of a upstream-side separation chamber so that said PCV valve is fastened into said centrifugal oil mist separator, wherein the opening of said blow-by gas outlet port is provided to be situated inwardly of an inner end of said internal thread, and wherein said oil separation plate is disposed between said inner end of said internal thread and the opening of said blow-by gas outlet port.

6. The air-oil separating apparatus according to claim 1, wherein a separation chamber housing of said centrifugal oil mist separator and a valve housing of said PCV valve are integrally formed of a resin.

7. The air-oil separating apparatus according to claim 1, wherein an blow-by gas inlet port opens in a tangential direction relative to an inner circumferential wall of an upstream-side separation chamber.

8. The air-oil separating apparatus according to claim 1, wherein an oil guide groove is formed in a bottom portion of a downstream-side separation chamber housing defining an downstream-side separation chamber.

9. The air-oil separating apparatus according to claim 8, wherein an oil discharge hole is formed in said oil guide groove.

10. The air-oil separating apparatus according to claim 1, wherein said centrifugal oil mist separator is transversely placed on an upper face of a head cover.

11. The air-oil separating apparatus according to claim 1, wherein said centrifugal oil mist separator is transversely placed on a side face of a head cover.

12. The air-oil separating apparatus according to claim 1, wherein said centrifugal oil mist separator is placed at a corner portion between upper and side faces of a head cover.

13. The air-oil separating apparatus according to claim 1, wherein said centrifugal oil mist separator is integrally molded into a head cover.

* * * * *